US008406650B2

(12) United States Patent
Kunihiro et al.

(10) Patent No.: US 8,406,650 B2
(45) Date of Patent: Mar. 26, 2013

(54) DEVELOPING DEVICE AND IMAGE FORMING APPARATUS

(75) Inventors: Hisashi Kunihiro, Osaka (JP); Jun Yamaguchi, Osaka (JP); Shuichi Akedo, Osaka (JP); Koichi Mihara, Osaka (JP)

(73) Assignee: Sharp Kabushiki Kaisha, Osaka-Shi (JP)

( * ) Notice: Subject to any disclaimer, the term of this patent is extended or adjusted under 35 U.S.C. 154(b) by 364 days.

(21) Appl. No.: 12/825,818

(22) Filed: Jun. 29, 2010

(65) Prior Publication Data

US 2011/0008068 A1 Jan. 13, 2011

(30) Foreign Application Priority Data

Jul. 8, 2009 (JP) ..... 2009-162124

(51) Int. Cl.
*G03G 21/20* (2006.01)
*G03G 15/08* (2006.01)

(52) U.S. Cl. ..... 399/93; 399/92; 399/252

(58) Field of Classification Search ..... 399/92, 399/93, 252, 254, 272
See application file for complete search history.

(56) References Cited

U.S. PATENT DOCUMENTS 4,377,334 A * 3/1983 Nishikawa ..... 399/103
4,583,112 A * 4/1986 Morano et al. ..... 399/103
4,963,930 A * 10/1990 Yoshimaru et al. ..... 399/252 X
5,887,227 A * 3/1999 Kawai et al. ..... 399/93 X
5,983,052 A * 11/1999 Fantuzzo et al. ..... 399/93
5,999,769 A * 12/1999 Anderson et al. ..... 399/93
7,346,296 B2 3/2008 Lee
2006/0153593 A1 7/2006 Lee
2009/0136257 A1 * 5/2009 Hattori et al. ..... 399/254 X

FOREIGN PATENT DOCUMENTS

JP 2005-346035 12/2005
JP 2006-195469 7/2006
JP 2009-037063 A 2/2009
JP 2009-115970 5/2009
JP 2009-128748 A 6/2009

* cited by examiner

*Primary Examiner* — Sandra Brase
(74) *Attorney, Agent, or Firm* — Nixon & Vanderhye P.C.

(57) ABSTRACT

A developing device is disclosed which includes a developing tank, a developing roller, a carrying member, and a filter. Rotation of the developing roller causes a first airflow directed from the outside of the developing tank through an air path to the inside of the developing tank. Rotation of the carrying member causes a second airflow directed from below in an upward direction inside the developing tank. Collision between the first airflow and the second airflow causes a third airflow directed from the inside of the developing tank through the filter to the outside of the developing tank and further from the outside through the filter back to the inside of the developing tank. This arrangement prevents not only filter clogging but also a toner leak to the outside of the developing device.

9 Claims, 6 Drawing Sheets

DEVELOPING DEVICE AND IMAGE FORMING APPARATUS

This Nonprovisional application claims priority under 35 U.S.C. §119(a) on Patent Application No. 2009-162124 filed in Japan on Jul. 8, 2009, the entire contents of which are hereby incorporated by reference.

TECHNICAL FIELD

The present technology relates to a developing device included in an electrophotographic image forming apparatus.

BACKGROUND ART

There have been known electrophotographic image forming apparatuses such as multifunction printers, copying machines, printers, and facsimile machines. An electrophotographic image forming apparatus is configured to (i) form an electrostatic latent image on a surface of a photoreceptor, (ii) cause a developing device to supply toner to the electrostatic latent image so that this image is developed to form a toner image, and (iii) transfer the toner image onto a sheet so as to fix the toner image on the sheet.

In recent years, an image forming apparatus capable of forming high-quality color images frequently uses a two-component developer (hereinafter also referred to simply as "developer"), which has an excellent stability in charging of toner. The developer includes toner and carrier, which are stirred in the developing device to cause friction between them. This friction allows properly charged toner to be obtained. The electrically charged toner is supplied onto a surface of a developing roller (developer bearing member). The toner on the surface of the developing roller is electrostatically attracted onto an electrostatic latent image formed on a photoreceptor. This forms a toner image on the photoreceptor.

Recently, there has been a demand for a high-speed, downsized image forming apparatus. This has in turn necessitated rapid supply of developer onto a developing roller. To charge developer rapidly and sufficiently, and also to supply the developer onto a developing roller rapidly, a developing device of a circulation type is preferably used. An example of a developing device of the circulation type is disclosed in Patent Literature 1 cited below.

In a developing device including a developing roller which rotates so that its outer surface moves from below in an upward direction while facing a photoreceptor, among gaps between the developing roller and a case (developing tank) containing the developing roller, gaps located respectively at opposite ends of the developing roller which ends are located along an axis direction of the developing roller are blocked by a sealing material. Further, a gap below the developing roller is blocked by developer on a surface of the developing roller. However, among the respective gaps, a gap above the developing roller provides an opening section for communicating inside of the developing device with outside thereof. This is because the developer above the developing roller is smaller in amount than the developer below the developing roller due to a developing process. Rotation of the developing roller causes an airflow through the opening section, thus flowing outside air through the opening section into the inside of the developing device. In view of this, the developing device normally has a vent, as disclosed in Patent Literature 1 cited below, formed so as to cause such outside air flown through the opening section to be discharged to the outside of the developing device. Further, the vent is provided with a filter for preventing toner inside the developing device from scattering to the outside.

CITATION LIST

Patent Literature 1

Japanese Patent Application Publication, Tokukai, No. 2009-115970 A (Publication Date: May 28, 2009)

SUMMARY OF TECHNOLOGY

Technical Problem

In the developing device having a vent such as the above, toner suspended in air in a developer container flows into the vent. This causes the toner and the carrier to accumulate on the filter at the vent, and thus problematically causes the filter to be clogged.

To solve this problem, Patent Literature 1 discloses a technique by which inside the developing device, a space between (i) a channel of the airflow from the opening section to the vent and (ii) the developer container is blocked by a developer brush formed on the developing roller. This technique is aimed at (i) sealing, with use of the developer brush formed on the developing roller, the area (i.e., developer container) in which toner is likely to be suspended (scattered) and thus (ii) preventing toner and carrier suspended in the area from flowing into the vent. This technique thereby prevents filter clogging.

According to the developing device of Patent Literature 1, however, the developer brush formed on the developing roller seals up the developer container, causing an increase in atmospheric pressure inside the developer container. This increase in the atmospheric pressure in turn causes toner suspended in the developer container to leak, from between (i) the developing roller and (ii) a sealing material provided in the vicinity of the ends of the developing roller, to the outside in accompany with the rotation of the developing roller. The toner leaking from the developing device of Patent Literature 1 is thus scattered to the outside of the developing device. This problematically results in contamination due to such toner.

The present technology has been accomplished in view of the above problems. It is an object of the present technology to provide a developing device capable of preventing not only filter clogging but also toner leak to the outside of the developing device.

Solution to Problem

In order to attain the above object, a developing device of the present technology includes: a developing tank for storing developer; a developing roller for bearing the developer so as to carry the developer to a photoreceptor provided outside the developing tank, the developing roller being provided to the developing tank so as to face the photoreceptor via an opening section of the developing tank; a carrying member for simultaneously stirring the developer in the developing tank and carrying the developer to the developing roller, the carrying member being provided to the developing tank so that the carrying member is provided on one side with respect to the developing roller while the photoreceptor is provided on the other side with respect to the developing roller; and an air path above the developing roller, the air path connecting the opening section of the developing tank to inside of the developing tank, the developing roller rotating so that an outer surface of the developing roller moves in a direction from the opening section to the inside while facing the air path and that the outer surface moves downwardly while facing the carrying member, the carrying member rotating so that its outer surface moves upwardly while facing the developing roller, the developing tank having a vent formed above the carrying member, and a filter provided to the vent, the filter being permeable to air but impermeable to the developer, the rotation of the developing roller causing a first airflow directed from the opening section of the developing tank along the air path to the inside of the developing tank, the rotation of the carrying member causing a second airflow directed upwardly from between the developing roller and the carrying member, collision between the first airflow and the second airflow causing a third airflow directed from the inside of the developing tank through the filter to outside of the developing tank and further directed from the outside through the filter back to the inside of the developing tank.

According to the arrangement of the present technology, the third airflow causes (i) air inside the developing tank to be discharged through the filter to the outside and (ii) air outside the developing tank to be flown through the filter into the developing tank. Thus, although developer inside the developing tank may temporarily be trapped by the filter, such developer trapped by the filter drops down into the inside of the developing tank. Consequently, the filter is not easily clogged, and the air inside the developing tank can be discharged through the filter to the outside. The arrangement of the present technology prevents filter clogging without partially blocking a space in the developing tank with use of developer on the developing roller as in Patent Literature 1. Thus, the arrangement prevents an increase in atmospheric pressure inside the developing tank and thereby prevents a toner leak from the developing device. In other words, the arrangement of the present technology not only prevents filter clogging, but also efficiently prevents a toner leak to the outside of the developing device as compared to conventional art.

Advantageous Effects of Technology

The developing device of the present technology not only prevents filter clogging, but also efficiently prevents a toner leak to the outside of the developing device as compared to conventional art.

DESCRIPTION OF EMBODIMENTS

A developing device according to an embodiment of the present technology is described below. Before the description of the developing device itself, an image forming apparatus including the developing device is described first.

[Image Forming Apparatus]

Figure 1:
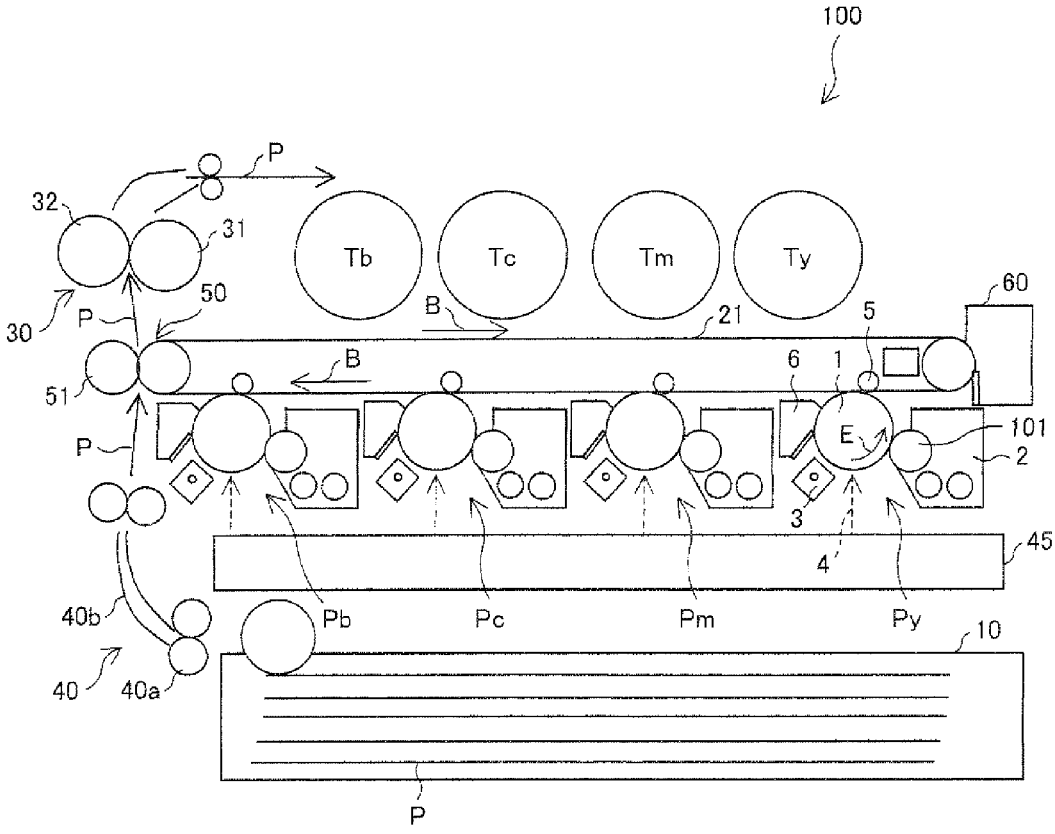
FIG. 1 is a longitudinal sectional view schematically illustrating an image forming apparatus in accordance with an embodiment of the present technology.

FIG. 1 is a longitudinal sectional view schematically illustrating an arrangement of the image forming apparatus. The image forming apparatus 100 is a tandem-type color printer which forms a color image, and includes a plurality of photoreceptors 1 each serving as an electrostatic latent image bearing member. (The image forming apparatus 100 of the present embodiment includes four photoreceptors used to form a yellow image, a magenta image, a cyan image, and a black image, respectively.)

Specifically, the image forming apparatus 100 functions as a printer for forming a color image and a monochrome image on a sheet P (transfer receiving material; recording medium) on the basis of, e.g., (i) image data transmitted from various terminal units, such as a personal computer (PC), connected via a network to the image forming apparatus 100, or (ii) image data read by a document reader such as a scanner. The network, the terminal units, and the document reader are omitted in FIG. 1.

As illustrated in FIG. 1, the image forming apparatus 100 includes: image forming sections Py, Pm, Pc, and Pb each for forming an image (toner image) on an intermediate transfer belt 21; a second transfer section 50 for transferring the image transferred on the intermediate transfer belt 21 onto a sheet P; a fixing device 30 for fixing the image transferred on the sheet P; a paper carrying section 40 for carrying the sheet P from a feeding tray 10, on which sheets P are stored, through the second transfer section 50 to the fixing device 30; and a belt cleaner section 60 for removing toner remaining on the intermediate transfer belt 21 after a second transfer.

The image forming apparatus 100 includes the following four image forming sections (image forming stations): the image forming section Py for forming a yellow image; the image forming section Pm for forming a magenta image; the image forming section Pc for forming a cyan image; and the image forming section Pb for forming a black image. The image forming sections Py, Pm, Pc, and Pb are linearly arranged in the above order along a direction (indicated by B in FIG. 1) in which the intermediate transfer belt 21 is rotated.

As illustrated in FIG. 1, the image forming apparatus 100 includes detachable toner bottles Ty, Tm, Tc, and Tb, and is arranged to supply toner, with use of supply means and control means (not shown), from each toner bottle via an intermediate toner hopper (indicated by a reference numeral 80 in FIG. 4) to a developing device 2 of a corresponding image forming section. The toner bottle Ty stores yellow toner to be supplied to a developing device of the image forming section Py. The toner bottle Tm stores magenta toner to be supplied to a developing device of the image forming section Pm. The toner bottle Tc stores cyan toner to be supplied to a developing device of the image forming section Pc. The toner bottle Tb stores black toner to be supplied to a developing device of the image forming section Pb.

The image forming sections Py, Pm, Pc, and Pb have a substantially identical arrangement. On the basis of image data for each color component, the image forming sections Py, Pm, Pc, and Pb form a yellow image, a magenta image, a cyan image, and a black image, respectively, so that these images are laid on top of one another on the intermediate transfer belt 21. This forms a full color image with toners of four colors. The color image thus formed is transferred onto a sheet P in the second transfer section 50. The color image (toner image) on the sheet P is then heated and pressed by the fixing device 30 so as to be fixed on the sheet P.

The image forming sections Py, Pm, Pc, and Pb each include a photoreceptor 1 on which an electrostatic latent image is formed. Further, each of the image forming sections Py, Pm, Pc, and Pb includes around the photoreceptor 1: a charging device 3; a signal light path 4; a developing device 2; a transfer device 5; and a cleaner 6, arranged in this order along a circumferential direction of the photoreceptor 1. FIG. 1 shows only reference numerals for the constituent members of the image forming section Py and omits reference numerals for the constituent members of the other image forming sections Pm, Pc, and Pb.

The photoreceptor 1 is a substantially cylindrical, drum-shaped member having on its surface a photosensitive material such as an organic photoconductor (OPC). The photoreceptor 1 is provided above an exposure device 45. The photoreceptor 1 is controlled by drive means and control means (not shown) so as to be driven to rotate in a predetermined direction (indicated by E in FIG. 1). The photoreceptor 1 of the present embodiment has a diameter of 30 mm.

The charging device 3 is scorotron charging means for uniformly charging the surface of the photoreceptor 1 to a predetermined potential. The charging device 3 is provided adjacently to the outer surface of the photoreceptor 1.

The exposure device (exposure unit) 45 irradiates, on the basis of image data supplied from an image processing section (not shown), the surface of the photoreceptor 1 with laser light for exposure, the surface having been charged by the charging device 3. The exposure device 45 thus lowers the potential at an exposed portion so as to write and form on the surface an electrostatic latent image corresponding to the image data. The exposure device 45 is arranged to expose the respective photoreceptors 1 of the image forming sections Py, Pm, Pc, and Pb on the basis of input data for a yellow image, a magenta image, a cyan image, and a black image so as to form electrostatic latent images of the respective colors.

The exposure device 45 of the present embodiment is a laser scanning unit (LSU) including a laser irradiation section and reflection mirrors. The exposure device 45 is, however, not limited to a laser scanning unit. The exposure device 45 may be a writing device (e.g., a writing head) including light-emitting elements, such as EL elements and LEDs, arranged in an array.

The developing device 2 stores developer. The developing device 2 makes visible (i.e., develops) an electrostatic latent image on the photoreceptor 1 with use of toner included in the developer. The toner in the developer is charged so as to have a polarity identical to a polarity of the potential of the charged surface of the photoreceptor 1. According to the present embodiment, both the potential of the charged surface of the photoreceptor 1 and the charged toner have a negative polarity. An arrangement of the developing device 2 is described below in further detail.

The transfer device (first transfer device) 5 transfers a toner image on the photoreceptor 1 onto the intermediate transfer belt 21. The transfer device 5 includes a first transfer roller to which a bias voltage is applied, the bias voltage having a polarity (positive polarity according to the present embodiment) reverse to the polarity of the charged toner.

The cleaner 6 removes and collects toner remaining on the outer surface of the photoreceptor 1 after an image transfer onto the intermediate transfer belt 21. The cleaner 6 includes a cleaning blade which abuts the surface of the photoreceptor 1. The cleaning blade is made of urethane rubber.

The intermediate transfer belt 21 is made of a semiconducting polyimide. The toner images on the respective photoreceptors 1 of the image forming sections Py, Pm, Pc, and Pb are transferred onto the intermediate transfer belt 21. This allows the toner images of the respective colors to be laid on top of one another on the intermediate transfer belt 21. This forms a color image on the intermediate transfer belt 21 with use of the toners of the four colors. The intermediate transfer belt 21 is rotated so that the color image is carried to the second transfer section 50.

The second transfer section 50 includes a second transfer roller 51 which is pressed against the intermediate transfer belt 21. A second transfer bias (positive potential) is applied to the second transfer roller 51 so as to attract the toner. A sheet P is carried to the second transfer section 50 in synchronization with an arrival of the toner image on the intermediate transfer belt 21 at the second transfer section 50 so that the toner image is transferred from the intermediate transfer belt 21 onto the sheet P.

The belt cleaner section (intermediate transfer cleaner) 60 removes and collects toner remaining on an outer surface of the intermediate transfer belt 21 after the second transfer. The belt cleaner section 60 includes a cleaning blade which abuts the intermediate transfer belt 21. Like the cleaning blade of the cleaner 6, the cleaning blade of the belt cleaner section 60 is made of urethane rubber.

The paper carrying section 40 carries a sheet P to the second transfer section 50. The paper carrying section 40 includes: a pair of registration rollers 40*a* for controlling a timing at which the sheet P is fed; and a sheet guide 40*b* for defining a path along which the sheet P is carried.

The fixing device 30 includes a heat roller 31 and a pressure roller 32. The sheet P is carried through a nip area between these rollers so that the toner image transferred on the sheet P is thermally compressed to be fixed on the sheet P.

According to the image forming apparatus 100 arranged as above, a sheet P carried along the paper carrying section 40 is passed through a position at which the intermediate transfer belt 21 faces the second transfer roller 51. At this stage, a transfer electric field from the second transfer roller 51 causes a combination of the toner images of the four colors on the intermediate transfer belt 21 to be transferred onto the sheet P. This allows a toner image of the four colors to be formed on the sheet P. The sheet P, on which the toner image has been thus transferred, is subjected to a fixing process for the toner image by the fixing device 30, and is then sent out onto a paper output tray (not shown).

[Developing Device]

The following describes an arrangement of the developing device of the present embodiment with reference to drawings. The description deals with the developing device 2 included in the image forming section Py. Each of the other image forming sections Pm, Pc, and Pb also includes a developing device identical to the developing device 2 described below.

Figure 2:
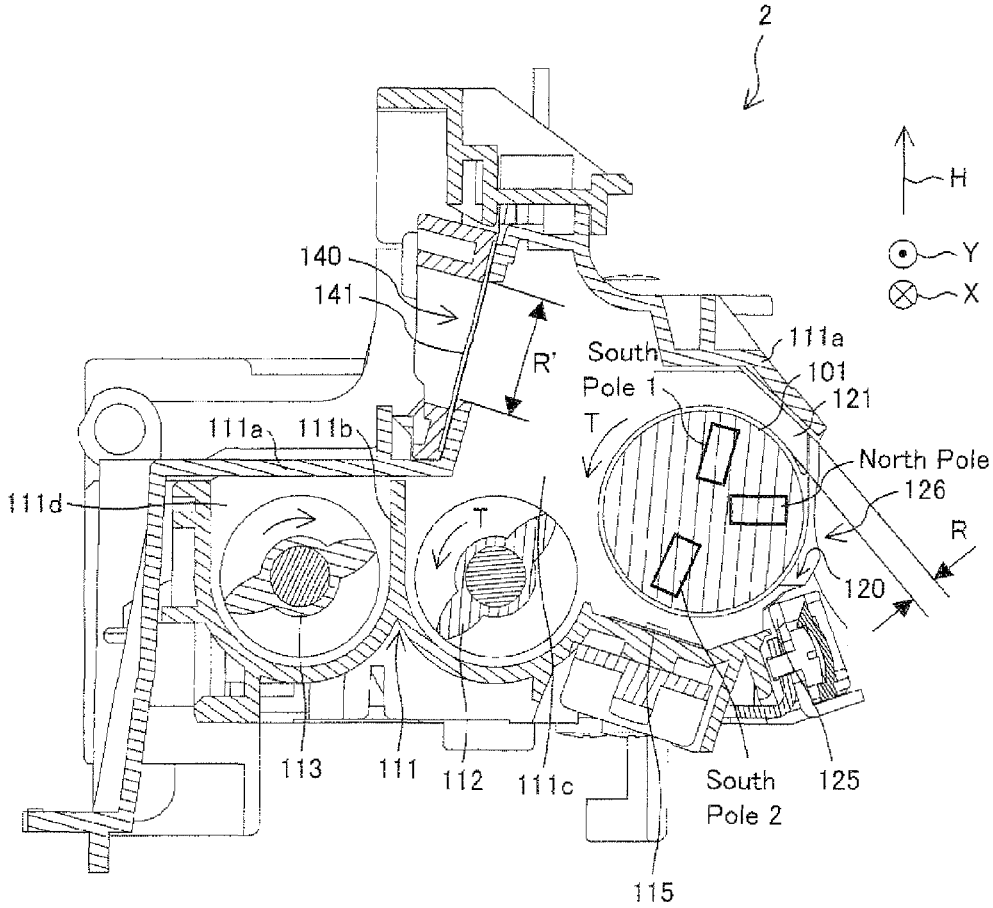
FIG. 2 is a longitudinal sectional view schematically illustrating a developing device in accordance with the present embodiment.

FIG. 2 is a longitudinal sectional view schematically illustrating the developing device 2 of the present embodiment. As illustrated in FIGS. 1 and 2, the developing device 2 includes a developing roller 101 provided so as to face a photoreceptor 1 at a predetermined distance. The developing device 2 causes the developing roller 101 to supply toner to a surface of the photoreceptor 1 for reversal development of an electrostatic latent image formed on the surface of the photoreceptor 1.

As illustrated in FIG. 2, the developing device 2 includes other than the developing roller 101: a developing tank 111; a doctor blade 125; a first carrying screw (carrying member) 112; and a second carrying screw 113.

The developing tank 111 is a tank which stores developer including toner and carrier. The developing tank 111 includes a developing tank cover 111*a* and a partition plate 111*b*. The carrier of the present embodiment is magnetic carrier.

Figure 3A:
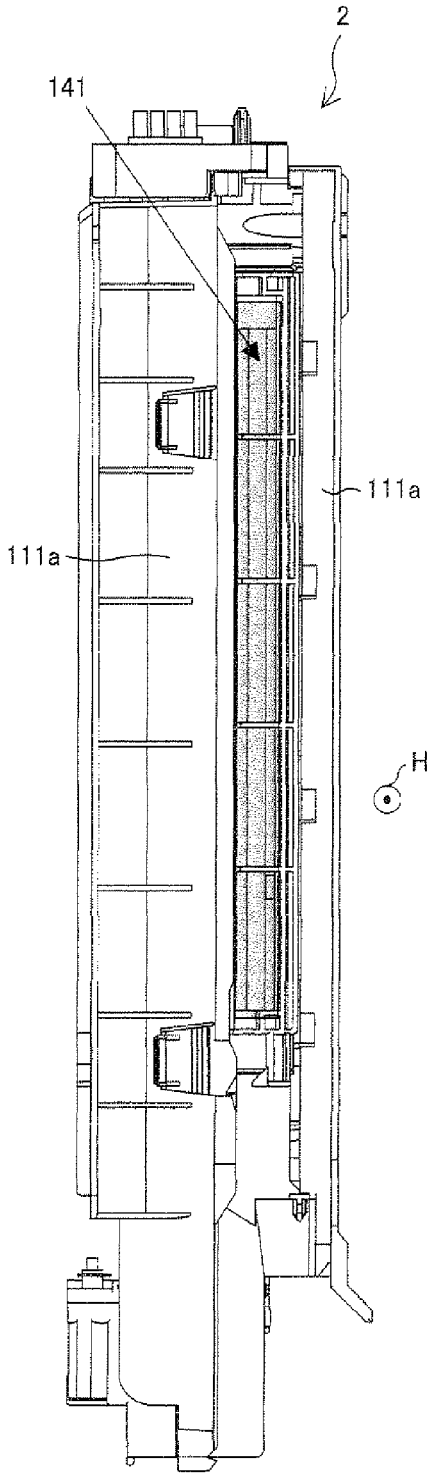
FIG. 3 (*a*) is a view illustrating the developing device as viewed in a direction (from above) opposite to an H direction shown in FIG. 2; and (*b*) is a view illustrating the developing device as viewed, in a state where a developing tank cover is detached, in the direction (from above) opposite to the H direction.
Figure 3B:
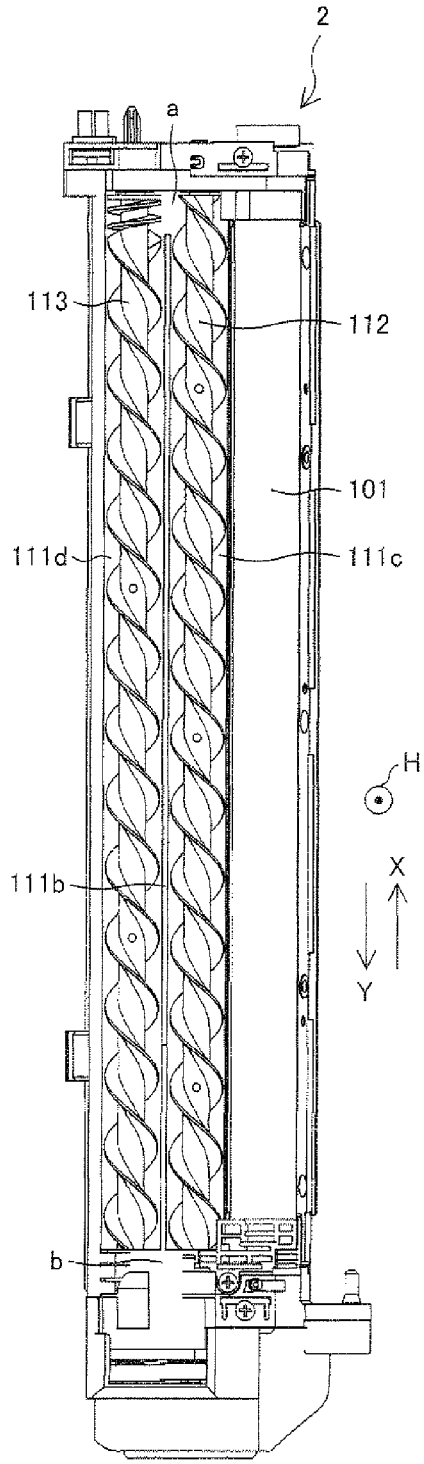

The developing tank cover 111*a*, which is a part of the developing tank 111, is detachable. With the developing tank cover 111*a* detached, an interior of the developing tank 111 is exposed as viewed from above the developing tank 111. (*a*) of FIG. 3 is a view illustrating the developing device 2 as viewed in a direction (from above) opposite to an H direction shown in FIG. 2. (*b*) of FIG. 3 is a view illustrating the developing device 2 as viewed, in a state where the developing tank cover 111*a* is detached, in the direction (from above) opposite to the H direction.

As illustrated in FIG. 2 and (*b*) of FIG. 3, the partition plate 111*b*, which is a part of the developing tank 111, is a wall for partitioning an interior space of the developing tank 111 into a first container 111*c* and a second container 111*d*. As illustrated in FIG. 2, the developing roller 101 and the first carrying screw 112 are provided in the first container 111*c*, whereas the second carrying screw 113 is provided in the second container 111*d*.

As illustrated in FIG. 2, the developing roller 101 is provided in the developing tank 111 so as to face the photoreceptor 1 via an opening section 126 formed in the developing tank 111. The developing roller 101 is separated from the developing tank 111 by gaps.

The developing roller 101 is supported by a bearing (not shown). The developing roller 101 includes: a cylindrical development sleeve provided so as to rotate in a T direction shown in FIG. 2; and a magnet roller provided inside the development sleeve so as not to rotate. As illustrated in FIG. 2, the magnet roller of the developing roller 101 includes: a south pole 1 for releasing developer borne on the developing roller 101 from the developing roller 101; a south pole 2 for attracting the developer in the developing tank 111 to the developing roller 101; and a north pole for forming a developer brush (which has a shape of a brush) in the vicinity of a development region. The developing roller 101 of the present embodiment has a diameter of 20 mm.

As illustrated in FIG. 2, the developing device 2 further includes a doctor blade (thickness controlling blade) 125 for controlling a thickness of developer on the developing roller 101. The doctor blade 125 is provided adjacently to a surface of the developing roller 101. The doctor blade 125 of the present embodiment is provided so that its front edge is separated from the developing roller 101 by a space, i.e., a doctor gap, having a length of 1.5 mm.

Figure 6:
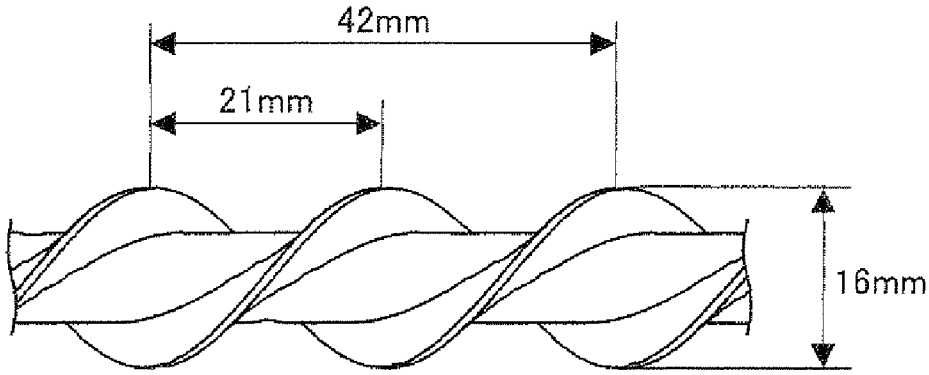
FIG. 6 is an explanatory view illustrating a diameter and a pitch of each of a first carrying screw and a second carrying screw.

As illustrated in (*b*) of FIG. 3, the first carrying screw 112 and the second carrying screw 113 are each a screw-shaped roller for stirring and carrying the developer in the developing tank 111. Each of the first carrying screw 112 and the second carrying screw 113 includes a spiral-shaped stirring wing for stirring and carrying the developer. Drive means (not shown) such as a motor drives a shaft of each carrying screw to rotate, so that the developer is stirred and carried. As illustrated in FIG. 6, the first carrying screw 112 and the second carrying screw 113 are each designed to measure 16 mm in diameter and 21 mm in pitch of the stirring wing.

As illustrated in FIG. 2 and (*b*) of FIG. 3, the first carrying screw 112 and the second carrying screw 113 are provided next to each other such that their respective surfaces face each other via the partition plate 111*b* and that their respective shafts lie parallel to each other. As illustrated in FIG. 2, the first carrying screw 112 and the second carrying screw 113 are configured to rotate in directions opposite from each other. The first carrying screw 112 carries developer in the first container 111*c* along an X direction shown in (*b*) of FIG. 3, whereas the second carrying screw 113 carries developer in the second container 111*d* along a Y direction shown in (*b*) of FIG. 3.

The partition plate 111*b* is provided so as to be separated from an inner wall surface of the developing tank 111 at both ends located along an axis direction of the first carrying screw 112 and the second carrying screw 113. The developing tank 111 thus has communicating paths formed to communicate the first container 111*c* with the second container 111*d* in the vicinity of the ends located along the axis direction of the first carrying screw 112 and the second carrying screw 113. Specifically, as illustrated in (*b*) of FIG. 3, a communicating path a is formed inside the developing tank 111, in the vicinity of a first end of the developing tank 111, the first end being located downstream in the X direction, whereas another communicating path (not shown; located in the vicinity of a position indicated by a reference numeral b) is formed inside the developing tank 111, in the vicinity of a second end of the developing tank 111, the second end being located downstream in the Y direction.

The image forming sections Py, Pm, Pc, and Pb of the present embodiment are each provided with an intermediate toner hopper (not shown in FIG. 1). The intermediate toner hopper receives toner from a corresponding toner bottle to store it temporarily, and feeds the stored toner to a corresponding developing device 2. The intermediate toner hopper provided to the image forming section Py, for example, receives toner from the toner bottle Ty to store it, and feeds the stored toner to the developing device 2 of the image forming section Py.

Figure 4:
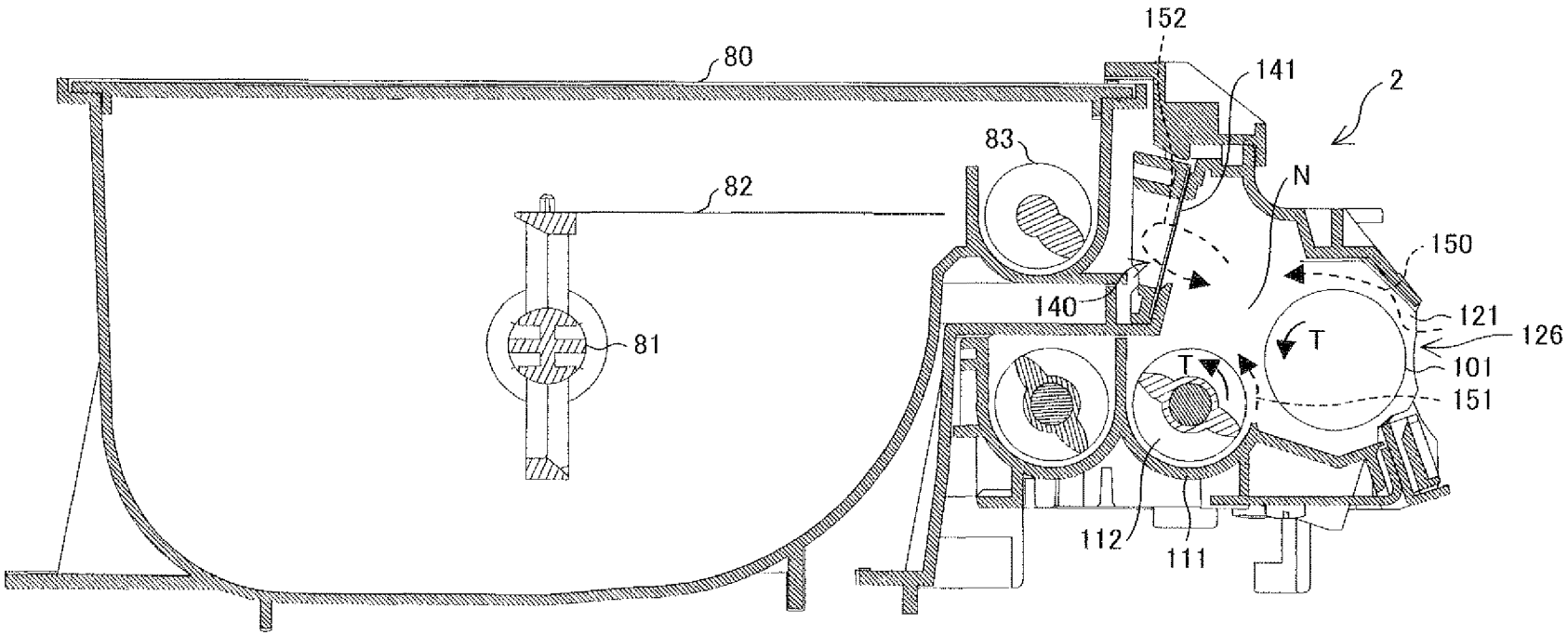
FIG. 4 is a cross-sectional view schematically illustrating the developing device and an intermediate toner hopper.

FIG. 4 is a cross-sectional view schematically illustrating the developing device 2 and the intermediate toner hopper 80 both provided to the image forming section Py. As illustrated in FIG. 4, the intermediate toner hopper 80 includes: a rotary shaft 81; a carrying sheet 82 mounted on the rotary shaft 81; and a supply roller 83.

The rotary shaft 81 is provided to rotate the carrying sheet 82. The carrying sheet 82 is configured to rotate so as to stir toner contained in the intermediate toner hopper 80 and so as to carry the toner to the supply roller 83.

The supply roller 83 is provided in the vicinity of a toner release opening (not shown) formed in a bottom of the intermediate toner hopper 80. The toner release opening is connected to an end of a toner carrying pipe (not shown). The other end of the toner carrying pipe is connected to a toner supply opening (not shown) of the developing device 2. Rotation of the supply roller 83 causes the toner in the intermediate toner hopper 80 to be carried from the toner release opening through the toner carrying pipe and the toner supply opening, so that the toner is dropped into the developing tank 111 of the developing device 2. The toner is thus supplied to the developing tank 111. A control device (not shown) controls operation of the supply roller 83 on the basis of an output from a toner density sensor 115 shown in FIG. 2. This control allows an amount of the toner in the developing tank 111 to be maintained within an appropriate range.

The intermediate toner hopper 80, which is capable of temporarily containing a large amount of toner, is provided as described above. Thus, even in a case where toner in the toner bottle is used up, since a large amount of toner can be stored in the intermediate toner hopper, it is possible to prevent the image forming apparatus 100 from stopping due to lack of toner, i.e., it is possible to allow the image forming apparatus 100 to continue operating. (Specifically, if the toner bottle is replaced before the intermediate toner hopper becomes empty, it is possible to prevent the image forming apparatus 100 from stopping due to lack of toner.)

The toner supply opening (not shown) is formed in the developing device 2 at a position above the second container 111*d* and downstream in the X direction. The toner in the intermediate toner hopper 80 is thus supplied via the toner supply opening into the second container 111*d* at the position downstream in the X direction.

With reference to (*b*) of FIG. 3, the following describes how developer in the developing device 2 is carried. First, toner is supplied from the intermediate toner hopper 80 into the second container 111*d* at a position downstream in the X direction. The supplied toner is thus mixed with developer already contained in the second container 111*d*. The developer in the second container 111*d* is stirred and carried in the Y direction by the second carrying screw 113. At an end, downstream in the Y direction, of the second container 111*d*, the developer is carried into the first container 111*c* via the communicating path (not shown) communicating the first container 111*c* with the second container 111*d*.

In the first container 111*c*, the developer is carried to the developing roller 101 by the first carrying screw 112. The first carrying screw 112 carries in the X direction (i) developer that has not been attracted to the developing roller 101 and/or (ii) developer that has been dropped from the developing roller 101. At an end, downstream in the X direction, of the first container 111*c*, the developer is carried into the second container 111*d* via the communicating path a.

The developer is, in other words, circulated in the developing tank 111. The developer as being carried in the first container 111*c* by the first carrying screw 112 is attracted to the surface of the developing roller 101 so as to be borne on the surface of the developing roller 101. Further, toner included in the developer on the surface of the developing roller 101 is sequentially moved to a corresponding photoreceptor 1 for consumption.

In the present embodiment, the photoreceptor 1 has a peripheral velocity which can be changed as appropriate. Respective peripheral velocities of the developing roller 101 and the carrying screws 112 and 113 are each set to a value corresponding to the peripheral velocity of the photoreceptor 1.

[Airflow]

The following describes airflows which occur in the developing device 2. The airflows are primarily caused by an air path 121, a vent 140, and a filter 141 all shown in FIG. 2. Thus, the description below first deals with the air path 121, the vent 140, and the filter 141 before the airflows themselves.

The air path 121 is described first. Among gaps between the developing roller 101 and the developing tank 111, gaps located respectively at opposite ends of the developing roller 101 which ends are located along an axis direction of the developing roller 101 are blocked by a sealing material (not shown). Among the gaps between the developing roller 101 and the developing tank 111, a gap (indicated by a reference numeral 120 in FIG. 2) located below the developing roller 101 is blocked by a developer layer borne by the developing roller 101. Among the gaps between the developing roller 101 and the developing tank 111, a gap located above the developing roller 101 is, in contrast, not blocked because the developer borne on the developing roller 101 has been consumed through a developing process. This gap thus provides the air path 121 for connecting an inside of the developing tank 111 with an outside thereof. An area of an inlet of the air path 121 which inlet is located closely to the outside of the developing tank 111 (i.e., closely to the opening section 126) is herein referred to as "ventilation area." The ventilation area can be determined by multiplying a width R shown in FIG. 2 by a length L of the inlet along the axis direction of the developing roller 101. The width R shown in FIG. 2 corresponds to a distance across the inlet between the developing roller 101 and the developing tank cover 111*a*. In the present embodiment, the width R of FIG. 2 is 3.3 mm, the length L is 300 mm, and the ventilation area is therefore 990 $mm^2$.

As illustrated in FIGS. 2 and 4, the developing tank 111 includes a vent 140 formed to discharge inside air to the outside. Further, as illustrated in FIG. 2, (*a*) of FIG. 3, and FIG. 4, the vent 140 is provided with a filter 141 for preventing toner inside the developing tank 111 from scattering to the outside.

The filter 141 allows air to pass through and traps the developer. The filter 141 of the present embodiment is Filtrete (registered trademark) GSB-70 manufactured by Sumitomo 3M Ltd. The filter 141 is a polypropylene air filter, which is not only excellent in air permeability and suspended toner filtration, but also high in durability.

In the present embodiment, an area of the filter 141 can be determined by multiplying a length L' of the filter 141 along the axis direction of the developing roller 101 by a width R' of the filter 141 (i.e., a length thereof along a direction perpendicular to the axis direction). The width R' is shown in FIG. 2. In the present embodiment, the width R' of FIG. 2 is 13 mm, the length L' is 215 mm, and the area of the filter 141 is therefore 2795 $mm^2$. This indicates that the area of the filter 141 is 2.82 times larger than the ventilation area of the air path 121.

As illustrated in FIGS. 2 and 4, the vent 140 and the filter 141 are provided above the first carrying screw 112. Further, the vent 140 and the filter 141 are positioned so as to face a space located between the developing roller 101 and the first carrying screw 112.

As illustrated in FIGS. 2 and 4, the developing roller 101 is rotated so that its outer surface moves in a direction from the opening section 126 to the inside of the developing tank 111 while facing the air path 121 and that the outer surface moves from above in a downward direction while facing the first carrying screw 112 (rotation in the T direction). As illustrated in FIG. 4, this rotation generates a first airflow 150 directed from the outside of the developing tank 111 through the opening section 126 and the air path 121 to the inside of the developing tank 111.

As illustrated in FIGS. 2 and 4, the first carrying screw 112 is configured to rotate in a direction (T direction) identical to the direction in which the developing roller 101 rotates. In other words, the first carrying screw 112 is rotated so that its outer surface moves from below in an upward direction while facing the developing roller 101. As illustrated in FIG. 4, this rotation generates a second airflow 151 directed upwardly from between the first carrying screw 112 and the developing roller 101 (i.e., upwardly from below).

The developing roller 101 discharges developer into a space between the developing roller 101 and the first carrying screw 112 due to (i) an influence of a magnetic field caused by the south pole 1 shown in FIG. 2 and (ii) a rotational force in the T direction. The first carrying screw 112 picks up developer between the developing roller 101 and the first carrying screw 112 due to a rotational force in the T direction. As illustrated in FIG. 4, the developer discharged from the developing roller 101 collides with the developer picked up by the first carrying screw 112 in a region N. The vent 140 and the filter 141 are positioned so as to face the region N.

The first airflow 150 generated by the developing roller 101 and the second airflow 151 generated by the first carrying screw 112 collide with each other either in the region N or slightly above the region N. As illustrated in FIG. 4, this collision generates a third airflow 152 directed from the inside of the developing tank 111 through the filter 141 to the outside of the developing tank 111 and further from the outside through the filter 141 back to the inside of the developing tank 111.

The developing device 2 of the present embodiment is configured such that a first portion of the third airflow 152 which first portion is directed from the inside of the developing tank 111 to the outside thereof causes air inside the developing tank 111 to be discharged to the outside. Although the first portion of the third airflow 152 may cause toner particles to be trapped by the filter 141, a second portion of the third airflow 152 which second portion is directed from the outside of the developing tank 111 to the inside thereof causes such toner trapped by the filter 141 to drop into the inside of the developing tank 111. Thus, according to the present embodiment, the filter 141 is not easily clogged, and also the air inside the developing tank 111 can be discharged to the outside through the filter 141.

As illustrated in FIG. 4, the first airflow 150 collides with the second airflow 151 in the space between the developing roller 101 and the first carrying screw 112. More specifically, the first airflow 150 collides with the second airflow 151 either in the region N or above the region N. Thus, as illustrated in FIG. 4, the filter 141 is positioned above the first carrying screw 112 so as to face the space between the developing roller 101 and the first carrying screw 112, or specifically so as to face the region N. This positioning facilitates securing a channel of the third airflow 152 (i.e., a channel extending from the inside of the developing tank 111 through the filter 141 to the outside of the developing tank 111 and further from the outside through the filter 141 back to the inside of the developing tank 111).

According to the present embodiment, while the air path 121 has a function of flowing outside air into the inside of the developing tank 111, the filter 141 has both a function of discharging air inside the developing tank 111 to the outside and a function of flowing outside air into the inside of the developing tank 111. Thus, imbalance between the area of the filter 141 and the ventilation area of the air path 121 would result in imbalance between an amount of air discharged from the developing tank 111 to the outside and that of air flown from the outside into the developing tank 111. This resulting imbalance may increase an atmospheric pressure inside the developing tank 111. An excessively high atmospheric pressure inside the developing tank 111 will result in toner leaking (i) in the space between the developing roller 101 and the developing tank 111, from between the developing roller 101 and the sealing material (not shown) provided in the vicinity of the opposite ends of the developing roller 101, and/or (ii) from between the filter 141 and the developing tank cover 111*a*.

In this regard, as is clear from an experimental example described below, the amount of air discharged from the developing tank 111 and that of air flown into the developing tank 111 are well balanced in a case where the area of the filter 141 is 1.74 or more but 4.34 times or less larger than the ventilation area of the air path 121 (i.e., the area of the inlet of the air path 121 which inlet is located closely to the outside of the developing tank 111). This balance prevents an increase in atmospheric pressure inside the developing tank 111 and consequently prevents the above toner leak. As described above, according to the present embodiment, the area of the filter 141 is 2.82 times larger than the ventilation area of the air path 121. Consequently, the toner is not easily leaked from between the developing roller 101 and the sealing material or from between the filter 141 and the developing tank cover 111*a*.

Another problem is that use of a filter having a low toner trapping efficiency causes more suspended toner to pass through the filter, whereas use of a filter having a high toner trapping efficiency more likely causes filter clogging.

Specifically, a test printing was performed by including in the developing device 2 a filter which has, under a condition of wind velocity of 20 to 100 cm/sec through the filter, a trapping efficiency of less than 38% for toner having a volume average particle size ($D_{50}$) of 0.3 μm. The test printing demonstrated that the filter causes a large amount of suspended toner to pass through, and that a problem of contamination due to such toner occurs as a result. Further, another test printing was performed by including in the developing device 2 a filter which has, under the condition of wind velocity of 20 to 100 cm/sec through the filter, a trapping efficiency of more than 60% for toner having a volume average particle size ($D_{50}$) of 0.3 μm. The test printing demonstrated that although the filter sufficiently traps and filters out suspended toner, the filter is likely to be clogged by toner particles. If a filter becomes clogged too easily, the atmospheric pressure inside the developing tank 111 is consequently increased. This gives rise to a problem of toner likely leaking from between the developing roller 101 and the sealing material (not shown) provided in the vicinity of the opposite ends of the developing roller 101.

Still another test printing was performed by including in the developing device 2 a filter which has, under the condition of wind velocity of 20 to 100 cm/sec through the filter, a trapping efficiency of not less than 38% but not more than 60% for toner having a volume average particle size ($D_{50}$) of 0.3 μm. The test printing demonstrated that the filter contrastingly causes no problem of toner contamination or a toner leak. Therefore, the developing device 2 preferably includes a filter which has, under the condition of wind velocity of 20 to 100 cm/sec through the filter, a trapping efficiency of not less than 38% but not more than 60% for toner having a volume average particle size ($D_{50}$) of 0.3 μm.

The volume average particle size ($D_{50}$) refers to a particle size in a particle size distribution based on volume of particles above and below which particle size particles are distributed in an identical number.

Experimental Example

As described above, the imbalance between the area of the filter 141 and the ventilation area of the air path 121 would result in the imbalance between the amount of air discharged from the developing tank 111 and that of air flown into the developing tank 111. This resulting imbalance would cause the problems of a toner scatter and a toner leak.

In view of this, the inventors of the present technology prepared Examples 1-5 and Comparative Examples 1-3. In these Examples 1-5 and Comparative Examples 1-3, a ratio of the area of the filter 141 to the ventilation area of the air path 121 differs from one another. A test printing (continuous printing of 100 000 sheets) was conducted with use of each of Examples 1-5 and Comparative Examples 1-3. The inventors took out each developing device 2 each time 10 000 sheets were printed, and thus visually evaluated (i) whether a toner scatter or toner drop had occurred at the opposite ends of the developing roller and (ii) whether a toner leak had occurred between the filter and the developing tank. Table 1 below shows a result of the evaluation. In Table 1, "G (good)" indicates that no toner scatter, toner drop, or toner leak occurred during the continuous printing of 100 000 sheets; "F (fair)" indicates that a toner scatter, toner drop, or toner leak was observed when the developing device 2 was taken out at the time when 80 000 sheets were printed; and "P (poor)" indicates that a toner scatter, toner drop, or toner leak was observed when the developing device 2 was taken out at the time when 50 000 sheets were printed.

TABLE 1

| | Ventilation Area | Filter Area | B/A Ratio | Toner Scatter/Toner Drop at Opposite Ends of Developing Roller | Toner Leak from Filter |
|---|---|---|---|---|---|
| Example 1 | 990 | 2,795 | 2.82 | G | G |
| Example 2 | 690 | 2,795 | 4.05 | G | G |
| Example 3 | 990 | 2,150 | 2.17 | G | G |
| Example 4 | 990 | 1,720 | 1.74 | F | F |
| Example 5 | 990 | 4,296 | 4.34 | F | F |
| Comparative Example 1 | 990 | 1,290 | 1.30 | P | P |
| Comparative Example 2 | 540 | 2,795 | 5.17 | P | P |
| Comparative Example 3 | 990 | 860 | 0.87 | P | P |

The result shown in Table 1 indicates that the area of the filter 141 is preferably 1.74 or more but 4.34 or less times larger, or more preferably 2.17 or more but 4.05 or less times larger, than the ventilation area of the air path 121. In the case where a relation between the area of the filter 141 and the ventilation area of the air path 121 is set as above, the amount of air discharged from the developing tank 111 and that of air flown into the developing tank 111 are well balanced. This balance prevents an increase in atmospheric pressure inside the developing tank 111 and consequently prevents a toner leak and a toner scatter. In a case where the area of the filter 141 is less than 1.74 times larger than the ventilation area of the air path 121, the amount of air discharged from the developing tank 111 and that of air flown into the developing tank 111 are imbalanced. This imbalance increases the atmospheric pressure inside the developing tank 111 and consequently causes toner to scatter from the vicinity of the opposite ends of the developing roller 101 and also to leak from between the filter 141 and the developing tank 111. In a case where the area of the filter 141 is more than 4.34 times larger than the ventilation area of the air path 121, the filter is problematically clogged.

Figure 5:
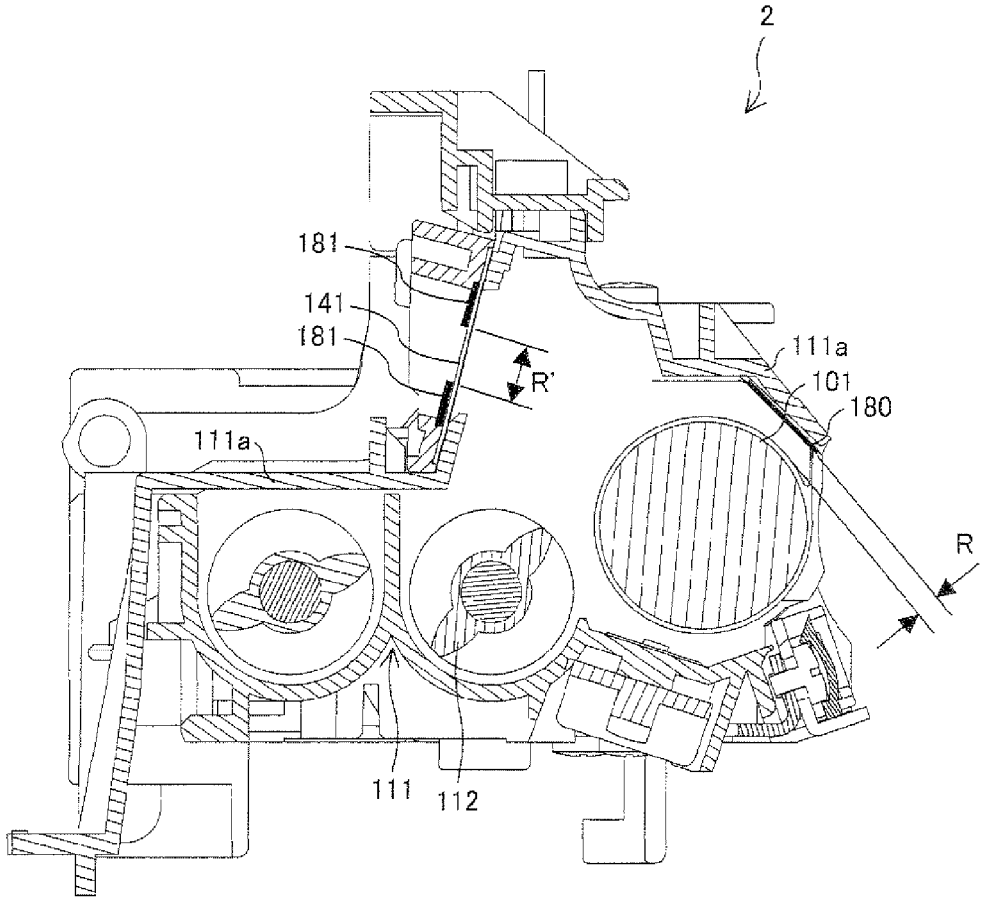
FIG. 5 is a view for description of how a ventilation area of an air path and an area of a filter are adjusted.

The above test printing was performed by printing a test image onto crosswise fed A4 sheets with use of a printer converted from multifunction color printer MX-7001N manufactured by Sharp Corporation. The test printing was conducted at a paper carrying speed (peripheral velocity of the photoreceptor) of 360 mm/sec. The developing roller 101 had a diameter of 30 mm and a peripheral velocity of 720 mm/sec (approximately twice the peripheral velocity of the photoreceptor). Each of the first carrying screw 112 and the second carrying screw 113 had the diameter and the pitch both shown in FIG. 6 and a peripheral velocity of 844 mm/sec (approximately 1.17 times the peripheral velocity of the developing roller). For the toners, the following genuine products from Sharp Corporation were used: MX-70NTBA (black), MX-70NTCA (cyan), MX-70NTMA (magenta), and MX-70NTYA (yellow). 1-3 of Table 1, the present experimental example was performed by adjusting the ventilation area of the air path 121 a As indicated in Examples 1-5 and Comparative Examples nd the area of the filter 141. The following describes how such adjustments were made. As illustrated in FIG. 5, a PET 1-3 of Table 1, the present experimental example was performed by adjusting the ventilation area of the air path 121 afilm 180 having a thickness of 0.5 mm was attached to a wall surface, along the air path 121, of the developing tank cover 111*a*. The PET film 180 was filed to adjust the width R of the inlet of the air path 121. The ventilation area of the air path 121 was thus adjusted. Further, as illustrated in FIG. 5, PET films 181 were attached to a portion of the filter 141. The PET films 181 were filed to adjust the width R'. The area of the filter 141 was thus adjusted.

As described above, the present embodiment is directed to a developing device including: a developing tank for storing developer; a developing roller for bearing the developer so as to carry the developer to a photoreceptor provided outside the developing tank, the developing roller being provided to the developing tank so as to face the photoreceptor via an opening section of the developing tank; a carrying member for simultaneously stirring the developer in the developing tank and carrying the developer to the developing roller, the carrying member being provided to the developing tank so that the carrying member is provided on one side with respect to the developing roller while the photoreceptor is provided on the other side with respect to the developing roller; and an air path above the developing roller, the air path connecting the opening section of the developing tank to inside of the developing tank, the developing roller rotating so that an outer surface of the developing roller moves in a direction from the opening section to the inside while facing the air path and that the outer surface moves downwardly while facing the carrying member, the carrying member rotating so that its outer surface moves upwardly while facing the developing roller, the developing tank having a vent formed above the carrying member, and a filter provided to the vent, the filter being permeable to air but impermeable to the developer, the rotation of the developing roller causing a first airflow directed from the opening section of the developing tank along the air path to the inside of the developing tank, the rotation of the carrying member causing a second airflow directed upwardly from between the developing roller and the carrying member, collision between the first airflow and the second airflow causing a third airflow directed from the inside of the developing tank through the filter to outside of the developing tank and further directed from the outside through the filter back to the inside of the developing tank.

According to the arrangement of the present embodiment, the third airflow causes (i) air inside the developing tank to be discharged through the filter to the outside and (ii) air outside the developing tank to be flown through the filter into the developing tank. Thus, although developer inside the developing tank may temporarily be trapped by the filter, such developer trapped by the filter drops down into the inside of the developing tank. Consequently, the filter is not easily clogged, and the air inside the developing tank can be discharged through the filter to the outside. The arrangement of the present embodiment prevents filter clogging without partially blocking a space in the developing tank with use of developer on the developing roller as in Patent Literature 1. Thus, the arrangement prevents an increase in atmospheric pressure inside the developing tank and thereby prevents a toner leak from the developing device. In other words, the arrangement of the present embodiment not only prevents filter clogging, but also efficiently prevents a toner leak to the outside of the developing device as compared to conventional art.

According to the arrangement of the present embodiment, the first airflow caused by the rotation of the developing roller and the second airflow caused by the rotation of the carrying member collide with each other either in the space located between the developing roller and the carrying member or in the vicinity of the space. Thus, the filter is positioned so as to face the space located between the developing roller and the carrying member. This positioning facilitates securing a channel of the third airflow (i.e., a channel extending from the inside of the developing tank through the filter to the outside of the developing tank and further from the outside through the filter back to the inside of the developing tank).

The developing device of the present embodiment is preferably arranged such that the filter is made of polypropylene. Such a filter can maintain its air permeability and suspended toner filtration at a high level. Further, the polypropylene filter is high in durability.

The inventors of the present technology have diligently conducted research and found the following in connection with the developing device of the present embodiment: In the case where the filter has an area which is 1.74 or more but 4.34 or less times larger than the ventilation area of the air path, the amount of air discharged from the developing tank to the outside and that of air flown from the outside into the developing tank are well balanced. As a result, an increase in atmospheric pressure inside the developing tank is prevented, and the toner is not likely leaked. The inventors have further found the following: In the case where the developing device of the present technology includes a filter which has, under the condition of wind velocity of 20 to 100 cm/sec through the filter, a trapping efficiency of not less than 38% but less than 60% for toner having a volume average particle size ($D_{50}$) of 0.3 μm, it is possible to more efficiently prevent a toner leak and contamination due to toner.

The image forming apparatus of the present embodiment includes the developing device described above. This arrangement not only prevents filter clogging, but also efficiently prevents a toner leak to the outside of the image forming apparatus as compared to conventional art.

Referential Example

The following describes toner usable in the image forming apparatus 100 of the present embodiment. The toner includes at least a binder resin, a coloring agent, and a release agent (wax). The binder resin is not particularly limited to a specific one. A binder resin for black toner or for a color toner is used. Examples of the binder resin encompass: a polyester resin; a styrene resin such as polystyrene and styrene-acrylic acid ester copolymer resin; an acrylic resin such as polymethylmethacrylate; a polyolefin resin such as polyethylene; polyurethane; and an epoxy resin.

The binder resin may also be a resin obtained by polymerization reaction induced by mixing a monomer mixture material with the release agent. The binder resin in this case preferably includes a polyester resin. The inclusion of the polyester resin in the binder resin improves controllability over dispersion of the release agent and consequently allows for production of toner having an improved fixing property. Further, such toner has an improved durability and transparency. Either a single binder resin or a combination of two or more binder resins may be used.

The polyester resin is not particularly limited to a specific one and may thus be a publicly known one. An example of the polyester resin is a product obtained by condensation polymerization of a polybasic acid with a polyhydric alcohol. The polybasic acid encompasses a polybasic acid and a derivative of a polybasic acid (e.g., an acid anhydride of a polybasic acid and an ester of a polybasic acid). The polyhydric alcohol refers to a compound containing two or more hydroxyl groups and encompasses any alcohol and phenol.

The polybasic acid is a compound commonly used as a monomer for a polyester resin. Examples of such a compound encompass: an aromatic carboxylic acid such as terephthalic acid, isophthalic acid, phthalic anhydride, trimellitic anhydride, pyromellitic acid, and naphthalenedicarboxylic acid; and an aliphatic carboxylic acid such as maleic anhydride, fumaric acid, succinic acid, and adipic acid. Either a single polybasic acid or a combination of two or more polybasic acids may be used.

The polyhydric alcohol is a compound commonly used as a monomer for a polyester resin. Examples of such a compound encompass: an aliphatic polyhydric alcohol such as ethylene glycol, propylene glycol, butanediol, hexanediol, neopentyl glycol, and glycerine; an alicyclic polyhydric alcohol such as cyclohexanediol, cyclohexanedimethanol, and hydrogenated bisphenol-A; and an aromatic diol such as an ethylene oxide adduct of bisphenol-A and a propylene oxide adduct of bisphenol-A.

The "bisphenol-A" refers to 2,2-bis(p-hydroxyphenyl)propane. An example of the ethylene oxide adduct of bisphenol-A is polyoxyethylene-2,2-bis(4-hydroxyphenyl)propane. An example of the propylene oxide adduct of bisphenol-A is polyoxypropylene-2,2-bis(4-hydroxyphenyl) propane. Either a single polyhydric alcohol or a combination of two or more polyhydric alcohols may be used.

The polyester resin can be synthesized by polycondensation reaction. The polyester resin can, for example, be synthesized by polycondensation reaction, specifically dehydration condensation reaction, of a polybasic acid with a polyhydric alcohol in the presence of a catalyst, either in organic solvent or in the absence of solvent. Alternatively, a methyl ester of a polybasic acid may be used as part of the polybasic acid to perform methanol-eliminating polycondensation reaction. The polycondensation reaction of the polybasic acid with the polyhydric alcohol may be ended when an acid value and softening point of a polyester resin being produced reach respective target values intended for a polyester resin to be synthesized.

In the polycondensation reaction, reaction conditions such as a blend ratio and reaction rate between the polybasic acid and the polyhydric alcohol may be changed as appropriate. This makes it possible to, for example, (i) adjust a content of a carboxyl group bonded to an end of a polyester resin to be obtained and consequently (ii) adjust property values such as the acid value and softening point of the polyester resin to be obtained.

The binder resin preferably has an acid value within a range from 5 mgKOH/g to 30 mgKOH/g. If the binder resin has an acid value of less than 5 mgKOH/g, affinity between the binder resin and the release agent is higher than in a case where the binder resin has an acid value of not less than 5 mgKOH/g. Consequently, the release agent does not easily rise to a surface of each toner particle during the fixing process, and a hot offset as a fixing fault is in turn more likely to occur. If the binder resin has an acid value of more than 30 mgKOH/g, a larger amount of a functional group remains on each toner surface, and thus the toner is more likely to absorb water than in a case where the binder resin has an acid value of not more than 30 mgKOH/g. As such, under a high humidity condition, a charge amount of the toner may decrease, and stability in charging of the toner may thus be impaired.

The release agent in the binder resin tends to have a low dispersibility. Thus, in a case where the toner is not kneaded sufficiently during the production, the release agent on the toner surface may in this case have a large dispersion diameter. Setting the acid value of the binder resin within the range from 5 mgKOH/g to 30 mgKOH/g allows the release agent in the toner particles to have a dispersibility within a desired range. Specifically, setting the acid value within the above range allows the release agent on the toner surface to stably have a dispersion diameter of less than 300 nm. This prevents the charge amount of the toner from decreasing under a high humidity condition, and controls the affinity between the binder resin and the release agent for a high fixing property.

Since the charging stability and the fixing property are improved as described above, a high-quality image which is high in definition and resolution can be formed more stably for an extended period of time. In the case where the monomer mixture material for the binder resin is, for example, a polyester resin, reaction conditions such as the blend ratio and reaction rate between the polybasic acid and the polyhydric alcohol can be changed as appropriate during the synthesis of the binder resin so as to adjust the content of a carboxyl group bonded to an end of the binder resin to be obtained and so as to consequently adjust the acid value of the binder resin to be obtained.

Examples of the coloring agent encompass: a coloring agent for yellow toner; a coloring agent for magenta toner; a coloring agent for cyan toner; and a coloring agent for black toner.

Examples of the coloring agent for yellow toner encompass (i) an organic pigment such as C.I. Pigment Yellow 1 (hereinafter in reference to the color index classification), C.I. Pigment Yellow 5, C.I. Pigment Yellow 12, C.I. Pigment Yellow 15, C.I. Pigment Yellow 17, C.I. Pigment Yellow 74, C.I. Pigment Yellow 93, C.I. Pigment Yellow 180, and C.I. Pigment Yellow 185, (ii) an inorganic pigment such as yellow iron oxide and ocher, (iii) a nitro dye such as C.I. Acid Yellow 1, and (iv) an oil soluble dye such as C.I. Solvent Yellow 2, C.I. Solvent Yellow 6, C.I. Solvent Yellow 14, C.I. Solvent Yellow 15, C.I. Solvent Yellow 19, and C.I. Solvent Yellow 21.

Examples of the coloring agent for magenta toner encompass C.I. Pigment Red 49 (hereinafter in reference to the color index classification), C.I. Pigment Red 57, C.I. Pigment Red 81, C.I. Pigment Red 122, C.I. Solvent Red 19, C.I. Solvent Red 49, C.I. Solvent Red 52, C.I. Basic Red 10, and C.I. Disperse Red 15.

Examples of the coloring agent for cyan toner encompass C.I. Pigment Blue 15 (hereinafter in reference to the color index classification), C.I. Pigment Blue 16, C.I. Solvent Blue 55, C.I. Solvent Blue 70, C.I. Direct Blue 25, and C.I. Direct Blue 86.

Examples of the coloring agent for black toner encompass a carbon black such as channel black, roller black, disc black, gas furnace black, oil furnace black, thermal black, and acetylene black. An appropriate carbon black may be selected from among these carbon blacks in consideration of a design property of toner to be obtained.

In addition to the above pigments, other pigments such as a crimson pigment and a green pigment can also be used. Either a single coloring agent or a combination of two or more coloring agents may be used. Further, two or more coloring agents of similar colors may be used. Alternatively, at least one coloring agent of a color may be combined with at least one coloring agent of a color dissimilar to the above color.

The coloring agent in the toner of the present embodiment is preferably masterbatched. The masterbatch of the coloring agent can be produced by, for example, kneading a fused synthetic resin and the coloring agent. The synthetic resin is either a resin identical in kind to the binder resin in the toner or a resin having a good compatibility with the binder resin in the toner. A use ratio of the coloring agent to the synthetic resin is not particularly limited. However, the ratio preferably falls within a range from 30 parts by weight to 100 parts by weight in relation to 100 parts by weight of the synthetic resin. The masterbatch has a particle size in the order of, e.g., 2 to 3 mm.

A content of the coloring agent in the toner is not particularly limited. However, the content preferably falls within a range from 4 parts by weight to 20 parts by weight in relation to 100 parts by weight of the binder resin. In the case where the above masterbatch is used, the masterbatch is preferably used in an amount adjusted so that the content of the coloring agent in the toner of the present embodiment falls within the above range. Setting the content of the coloring agent within the range makes it possible to form a high-quality image having a sufficient density and a high color property.

The release agent is not particularly limited to a specific one and may be a publicly known release agent. Examples of the release agent encompass (i) a petroleum wax such as paraffin wax and a derivative thereof; and microcrystalline wax and a derivative thereof, (ii) a hydrocarbon synthetic wax such as Fischer-Tropsch wax and a derivative thereof; polyolefin wax and a derivative thereof; low-molecular polypropylene wax and a derivative thereof; and polyolefin polymer wax and a derivative thereof, (iii) carnauba wax and a derivative thereof, and (vi) an ester wax.

The release agent of the present embodiment is preferably contained in an amount which falls within a range from 1.5% by weight to 5% by weight in relation to a total weight of the toner. If the content is less than 1.5% by weight, the toner has a low releasing property with respect to a belt, and a fixing offset occurs as a result. On the other hand, if the content is more than 5% by weight, although the fixing property is good, the toner particles are agglomerated due to heat generated by stirring of the toner in the developing device, and thus it is impossible to form an image having a good quality. The release agent has an acid value of less than 4 mgKOH/g. If the release agent has an acid value of not less than 4 mgKOH/g, affinity between the release agent and the binder resin is higher than in a case where the release agent has an acid value of less than 4 mgKOH/g. Consequently, the release agent does not easily rise to the surface of each toner particle during the fixing process, and a hot offset is in turn more likely to occur.

The toner preferably includes, other than the combination of the binder resin, the coloring agent, and the release agent, a toner additive component such as a charge control agent. The inclusion of the charge control agent allows the toner to have a preferable charging property. The charge control agent is a charge control agent either for controlling a positive charge or for controlling a negative charge.

Examples of the charge control agent encompass (i) a charge control agent for controlling a positive charge, such as nigrosine dye; basic dye; quaternary ammonium salt; quaternary phosphonium salt; aminopyrine; pyrimidine compound; polynuclear polyamino compound; aminosilane; nigrosine dye; a derivative of nigrosine dye; triphenylmethane derivative; guanidine salt; and amidin salt, and (ii) a charge control agent for controlling a negative charge, such as an oil soluble dye (e.g., oil black and spirone black); metal-containing azo compound; azo complex dye; naphthene acid metal salt; a metal complex and metal salt of salicylic acid and of a derivative of salicylic acid (where the metal is, e.g., chrome, zinc, or zirconium); boron compound; fatty acid soap; long-chain alkyl carboxylic acid salt; and resin acid soap. Either a single charge control agent or a combination of two or more charge control agents may be used.

The charge control agent is contained preferably in an amount which falls within a range from 0.5 part by weight to 5 parts by weight in relation to 100 parts by weight of the binder resin, or more preferably in an amount which falls within a range from 0.5 part by weight to 3 parts by weight in relation to 100 parts by weight of the binder resin. If the charge control agent is contained in an amount which is more than 5 parts by weight, the carrier will be contaminated and the toner may be scattered as a result. If the charge control agent is contained in an amount which is less than 0.5 part by weight, the toner will not have a sufficient charging property.

The toner of the present embodiment preferably has a volume average particle size within a range from 5.0 μm to 7.0 μm. Toner particles having a number average particle size of not more than 5.0 μm are contained in the toner preferably in a number which is less than 40% by number of all toner particles. Setting the particle size distribution and number distribution of the toner within the above respective ranges prevents the toner from scattering and consequently makes it possible to form a high-quality image which is high in definition and resolution. If the volume average particle size is less than 5.0 μm, the toner will be scattered due to a low fluidity. If the volume average particle size is more than 7.0 μm, it will be impossible to form an image which is sufficiently high in definition and resolution. If toner particles having a number average particle size of not more than 5.0 μm are contained in a number which is not less than 40% by number of all toner particles, the toner will be scattered due to a low fluidity, and a photographic fog will be caused due to a low transfer efficiency. In the present embodiment, the content (% by volume, % by number) of toner particles having a volume average particle size ($D_{50}$) and number average particle size of not more than 5.0 μm is measured with particle size analyzer "Multisizer 3" manufactured by Beckman Coulter, Inc. Measurement conditions are shown below.

Aperture diameter: 100 μm

Measurement particle count: 50 000 counts

Analysis software: Coulter Multisizer AccuComp, version 1.19 (manufactured by Beckman Coulter, Inc.)

Electrolyte solution: ISOTON-II (manufactured by Beckman Coulter, Inc.)

Dispersing agent: sodium alkyl ether sulfate

The measurement is made as follows: First, 50 ml of the electrolyte solution, 20 mg of sample toner, and 1 ml of the dispersing agent are charged in a beaker. The mixture is subjected to a dispersing treatment in an ultrasonic dispersing device for three minutes to prepare a measurement sample. The sample is then measured with measuring apparatus "Multisizer 3" for particle sizes. On the basis of a result of the measurement, a volume particle size distribution and number particle size distribution of the sample particles are determined. On the basis of the volume particle size distribution, a volume average particle size ($D_{50}$) of the toner is determined. Further, on the basis of the number particle size distribution, a content (% by number) of toner particles having a number average particle size of not more than 5.0 μm is determined.

The toner may include an external additive having a function of, e.g., (i) improving a powder fluidity, triboelectric charging property, heat resistance, keeping property, or cleaning property, or (ii) controlling a wear property of the photoreceptor surface. Examples of the external additive encompass fine powder of silica, titanic oxide, and alumina. Either a single external additive or a combination of two or more external additives may be used.

The external additive is added preferably in an amount which falls within a range from 0.1 part by weight to 10 parts by weight, or more preferably in an amount which is not less than 2.0 parts by weight and less than 4.0 parts by weight, in relation to 100 parts by weight of the toner particles. This is in view of, e.g., a necessary charge amount of the toner; influence of the addition of the external additive on wear of the photoreceptor; and a property of the toner which property affects the surroundings of the toner. Including the external additive in an amount which is not less than 2.0 parts by weight and less than 4.0 parts by weight enables a further improvement in the fluidity and appropriate control of the charging of the individual toner particles. This in turn makes it possible to prevent impairment of the fixing property and thus prevent occurrence of a photographic fog. As a result, it is possible to form a high-quality image.

If the content of the external additive is less than 2.0 parts by weight, the toner (particularly, small toner particles) will not have a sufficient fluidity. Consequently, the individual toner particles will not be sufficient charged, and a photographic fog will thus be likely to occur in an area where no image is formed. If the content of the external additive is not less than 4.0 parts by weight, external additive particles will be likely to agglomerate. This will prevent the external additive from efficiently coating each toner surface and thus prevent the fluidity from being improved. Consequently, the individual toner particles will not be sufficient charged, and a photographic fog will thus be likely to occur in an area where no image is formed.

The above-described toner can be produced as follow: A resin composition including at least the binder resin, the coloring agent, and the release agent (wax) is dry-mixed (premixed), fused, kneaded, ground, and classified to prepare cores of the toner. The cores of the toner are then dry-mixed with the external additive to produce the toner. A publicly known mixer can be used for the dry-mixing. Examples of the mixer encompass (i) a Henschel type mixer such as a Henschel Mixer (product name: FM Mixer; manufactured by Mitsui Mining Co., Ltd.), Super Mixer (product name; manufactured by Kawata Mfg. Co., Ltd.), and Mechano Mill (product name; manufactured by Okada Seiko Co., Ltd.), (ii) Ong Mill (product name; manufactured by Hosokawa Micron Corporation), (iii) Hybridization System (product name; manufactured by Nara Machinery Co., Ltd.), and (iv) Cosmo System (product name; manufactured by Kawasaki Heavy Industries Ltd.).

In the production of the toner, the release agent is contained during the above-mentioned premixing in an amount which falls within a range from 2.5 parts by weight to 6.0 parts by weight in relation to 100 parts by weight of the binder resin. For the kneading, a publicly known mill is used. A normal mill is thus used such as a two shaft extruder, a three-roll mill, and a Labo Plastmill. Specific examples of the mill encompass (i) a one shaft or two shaft extruder such as TEM-100B (product name; manufactured by Toshiba Machine Co., Ltd.); and PCM-65/87 and PCM-30 (product names; manufactured by Ikegai Corporation), and (ii) an open-roll mill such as Kneadex (product name; manufactured by Mitsui Mining Co., Ltd.). Among these mills, the open-roll mill is preferable. The toner material mixture may be fused and kneaded in a plurality of mills.

The toner particles are ground in, e.g., a jet mill for performing grinding with use of a supersonic jet; or an impact mill for grinding a coarsely ground product introduced into a space formed between a rapidly rotating rotor and a liner serving as a stator.

The classification is performed with a publicly known classification device capable of removing excessively ground toner particles and coarse toner particles through classification using centrifugal force or wind power. An example of such a classification device is a rotary wind power classification device.

The toner particles may be subjected to a rounding treatment. In a case where the rounding treatment is performed with use of mechanical impact, a commercially available impact type rounding device may be used. An example of the impact type rounding device is Faculty (product name; manufactured by Hosokawa Micron Corporation). In a case where the rounding treatment is performed with use of heated air, a commercially available heated air type rounding device may be used. An example of the heated air type rounding device is surface reformer Meteor Rainbow (product name; manufactured by Nippon Pneumatic Mfg. Co., Ltd.). The rounding treatment is preferably performed so that the toner particles have a roundness within a range from 0.950 to 0.960.

The toner produced as described above can be used by itself as a one component developer. Such a developer has a good fixing property and a good charging stability, and has properties that are stable over an extended period of use. The developer can thus maintain a good development property.

The toner produced as described above is preferably mixed with carrier for use as a two component developer. The toner produced as described above has an excellent storage stability, and thus a decrease in the fluidity is prevented. As such, the two component developer has a good charging stability and a good development property. The use of the two component developer makes it possible to stably form, for an extended period of time, a high-quality image which is high in definition and resolution and which is free from a toner scatter.

The carrier included in the two component developer is made up of magnetic particles. Specific examples of the magnetic particles encompass particles of (i) a metal such as iron, ferrite, and magnetite, and (ii) an alloy of the metal and another metal such as aluminum and lead. Among these, ferrite particles are preferable.

The two component developer may include, for example, (i) resin-coated carrier, which is made up of magnetic particles coated in a resin, or (ii) resin dispersion carrier, which is made up of magnetic particles dispersed in a resin. The resin used for the resin-coated carrier is not particularly limited to a specific one; preferable examples of the resin encompass olefin resin, styrene resin, styrene/acrylic resin, silicon resin, ester resin, and fluorine-containing polymer resin. The resin used for the resin dispersion carrier is not particularly limited to a specific one; preferable examples of the resin encompass styrene acrylic resin, polyester resin, fluorine resin, and phenol resin.

Particles of the carrier preferably have a spherical or flat shape. A volume average particle size of the carrier is not particularly limited. To form a high-quality image, the volume average particle size falls preferably within a range from 10 μm to 100 μm, or more preferably within a range from 30 μm to 50 μm. If the carrier has a volume average particle size of less than 10 μm, a magnetic force acting between the carrier and the developing roller will be lower than in a case where the carrier has a volume average particle size of not less than 10 μm. This low magnetic force will result in the carrier being likely developed together with the toner during the development step. If the carrier has a volume average particle size of more than 100 μm, the individual toner particles may not be sufficiently charged. Setting the volume average particle size of the carrier within the range from 10 μm to 100 μm allows the toner and the carrier to contact each other via a wider area than in the case where the carrier has a volume average particle size of more than 100 μm. Consequently, the charging of the individual toner particles can be controlled, and the toner thus has a sufficient charging property. As a result, it is possible to produce a two component developer including toner having a good development property. Setting the volume average particle size of the carrier within the range from 30 μm to 50 μm allows the above effects to be achieved more stably.

The volume average particle size of the carrier can be measured with laser diffraction/scattering type particle size/particle size distribution analyzer Micro Trac (product name: Micro Trac MT3000; manufactured by Nikkiso Co., Ltd.).

The following specifically describes a method of producing the toner. In a Henschel Mixer, 81.8 parts by weight of polyester resin A; 12 parts by weight of a masterbatch (containing 40% by weight of C.I. Pigment Red 57:1); 5.0 parts by weight of paraffin wax (release agent; product name: HNP10; manufactured by Nippon Seiro Co., Ltd.; acid value: 0 mgKOH/g; melting point: 75° C.); and 1.5 parts by weight of alkylsalicylic acid metal salt (charge control agent; product name: BONTRON E-84; manufactured by Orient Chemical Industries Ltd.) are mixed for 10 minutes to prepare a mixture. This mixture is fused and kneaded in an open-roll continuous mill (product name: MOS320-1800; manufactured by Mitsui Mining Co., Ltd.) to provide a kneaded product. This kneaded product is coarsely ground in a cutter mill (product name: VM-16; manufactured by Ryoko Industry Ltd.) to provide a coarsely ground product. This coarsely ground product is then finely ground in a counter jet mill. After this fine grinding, toner particles which have been ground too finely are removed through classification in a rotary classification device. This provides toner cores having a volume average particle size of approximately 6.7 μm.

Next, the toner cores are rounded in an impact type rounding device (product name: Faculty F-600; manufactured by Hosokawa Micron Corporation). Then, 100 parts by weight of the toner are mixed in a Henschel Mixer (product name: FM Mixer; manufactured by Mitsui Mining Co., Ltd.) with 3.8 parts by weight of an external additive including 2.2 parts by weight of hydrophobic silica (product name: R-974; manufactured by Nippon Aerosil Co., Ltd.) and 1.6 parts by weight of hydrophobic titanium (product name: T-805; manufactured by Nippon Aerosil Co., Ltd.). The external additive is thus added to the toner. The wax is contained in an amount which is 4.8% by weight in relation to a total weight of the toner.

In a case where the paraffin wax is contained in an amount which is (i) 1.5 parts by weight (1.49% by weight in relation to the total weight of the toner), (ii) 2 parts by weight (1.98% by weight in relation to the total weight of the toner), or (iii)

3.5 parts by weight (3.41% by weight in relation to the total weight of the toner), the fixing property is good, no toner particles are agglomerated in the developing device, and an image having a good quality can thus be formed. Hence, for good toner properties, the wax is contained in an amount which falls within a range from 1.5% by weight to 4.8% by weight. If the paraffin wax is contained in an amount which is 1 part by weight (1.0% by weight in relation to the total weight of the toner), a fixing offset occurs. If the paraffin wax is contained in an amount which is 5.5 parts by weight (5.26% by weight in relation to the total weight of the toner), although the fixing property is good, the toner particles are agglomerated in the developing device, and such agglomerated toner particles are thus visible in an image formed.

After the addition of the external additive, the toner produced as described above and ferrite core carrier having a volume average particle size of 45 μm are mixed for 20 minutes so that the toner particles coat 60% of surfaces of carrier particles, whereby a two component developer is produced. This mixing can be performed with a V-type mixer (product name: V-5; manufactured by Tokujyu Industry Co., Ltd.).

The above description deals with a grinding method as an example method of producing the toner of the present embodiment. The method is, however, not particularly limited to grinding. Examples of the method encompass: suspension polymerization; emulsion polymerization (emulsion aggregation); dissolution suspension method; and ester elongation polymerization.

The image forming apparatus 100 of the above embodiment is a color printer. However, the image forming apparatus may naturally be a monochrome printer instead. The image forming apparatus 100 may be a printer included in a copying machine, or a printer included in a multifunction printer.

The present technology is not limited to the description of the embodiments above, but may be altered in various ways by a skilled person within the scope of the claims. Any embodiment based on a proper combination of technical means disclosed in different embodiments is also encompassed in the technical scope of the present technology.

INDUSTRIAL APPLICABILITY

The developing device and image forming apparatus of the present technology are suitably applicable to an electrophotographic multifunction printer, copying machine, printer, and facsimile.

| Reference Signs List | |
|---|---|
| 1 | photoreceptor |
| 2 | developing device |
| 100 | image forming apparatus |
| 101 | developing roller |
| 111 | developing tank |
| 111a | developing tank cover |
| 112 | first carrying screw (carrying member) |
| 113 | second carrying screw |
| 121 | air path |
| 126 | opening section |
| 140 | vent |
| 141 | filter |
| 150 | first airflow |
| 151 | second airflow |
| 152 | third airflow |

The invention claimed is:

1. A developing device comprising:

a developing tank for storing developer;

a developing roller for bearing the developer so as to carry the developer to a photoreceptor provided outside the developing tank, the developing roller being provided to the developing tank so as to face the photoreceptor via an opening section of the developing tank;

a carrying member for simultaneously stirring the developer in the developing tank and carrying the developer to the developing roller, the carrying member being provided to the developing tank so that the carrying member is provided on one side with respect to the developing roller while the photoreceptor is provided on the other side with respect to the developing roller; and an air path above the developing roller, the air path connecting the opening section of the developing tank to inside of the developing tank, the developing roller rotating so that an outer surface of the developing roller moves in a direction from the opening section to the inside while facing the air path and that the outer surface moves downwardly while facing the carrying member, the carrying member rotating so that its outer surface moves upwardly while facing the developing roller, the developing tank having a vent formed above the carrying member, and a filter provided to the vent, the filter being permeable to air but impermeable to the developer, wherein the filter has an area which is 1.74 times or more but 4.34 times or less larger than a ventilation area, which is an area of an inlet of the air path, the inlet being opened to the opening section, the rotation of the developing roller causing a first airflow directed from the opening section of the developing tank along the air path to the inside of the developing tank, the rotation of the carrying member causing a second airflow directed upwardly from between the developing roller and the carrying member, collision between the first airflow and the second airflow causing a third airflow directed from the inside of the developing tank through the filter to outside of the developing tank and further directed from the outside through the filter back to the inside of the developing tank.

2. The developing device according to claim 1, wherein the filter is provided so as to face a space located between the developing roller and the carrying member.

3. The developing device according to claim 1, wherein the filter is made of polypropylene.

4. The developing device according to claim 1, wherein under a condition of wind velocity of 20 to 100 cm/sec through the filter, the filter has a trapping efficiency of not less than 38% but less than 60% for toner having a volume average particle size ($D_{50}$) of 0.3 μm.

5. An image forming apparatus comprising a developing device recited in claim 1.

6. A developing device comprising:

a developing tank for storing developer;

a developing roller for bearing the developer so as to carry the developer to a photoreceptor provided outside the developing tank, the developing roller being provided to the developing tank so as to face the photoreceptor via an opening section of the developing tank;

a carrying member for simultaneously stirring the developer in the developing tank and carrying the developer to the developing roller, the carrying member being provided to the developing tank so that the carrying member is provided on one side with respect to the developing roller while the photoreceptor is provided on the other side with respect to the developing roller; and an air path above the developing roller, the air path connecting the opening section of the developing tank to inside of the developing tank, the developing roller rotating so that an outer surface of the developing roller moves in a direction from the opening section to the inside while facing the air path and that the outer surface moves downwardly while facing the carrying member, the carrying member rotating so that its outer surface moves upwardly while facing the developing roller, the developing tank having a vent formed above the carrying member, and a filter provided to the vent, the filter being permeable to air but impermeable to the developer, the rotation of the developing roller causing a first airflow directed from the opening section of the developing tank along the air path to the inside of the developing tank, the rotation of the carrying member causing a second airflow directed upwardly from between the developing roller and the carrying member, collision between the first airflow and the second airflow causing a third airflow directed from the inside of the developing tank through the filter to outside of the developing tank and further directed from the outside through the filter back to the inside of the developing tank, wherein under a condition of wind velocity of 20 to 100 cm/sec through the filter, the filter has a trapping efficiency of not less than 38% but less than 60% for toner having a volume average particle size ($D_{50}$) of 0.3 μm.

7. The developing device according to claim 6, wherein the filter is provided so as to face a space located between the developing roller and the carrying member.

8. The developing device according to claim 6, wherein the filter is made of polypropylene.

9. An image forming apparatus comprising a developing device recited in claim 6.

* * * * *